US005363731A

United States Patent [19]

Grafe

[11] Patent Number: 5,363,731

[45] Date of Patent: Nov. 15, 1994

[54] APPARATUS FOR DISPLACING AND ADJUSTING POWERED ROLLS SUPPORTED IN CROSSBEAMS FOR CONVEYING METAL PLATES

[75] Inventor: Horst Grafe, Hilchenbach, Germany

[73] Assignee: SMS Schloemann-Siegmag Aktiengesellschaft, Dusseldorf, Germany

[21] Appl. No.: 740,318

[22] Filed: Aug. 5, 1991

[30] Foreign Application Priority Data

Aug. 4, 1990 [DE] Germany ..... 4024824

[51] Int. Cl.[5] ..... B23D 19/00

[52] U.S. Cl. ..... 83/436; 72/244; 198/782

[58] Field of Search ..... 83/436, 344; 29/117; 198/624, 782; 72/244

[56] References Cited

U.S. PATENT DOCUMENTS 949,464 2/1910 Dean ..... 72/244
2,601,793 4/1952 Wood ..... 72/238

FOREIGN PATENT DOCUMENTS 3542007 6/1987 Germany .
0255204 12/1985 Japan ..... 72/244

*Primary Examiner*—Eugenia Jones
*Assistant Examiner*—Allan M. Schrock
*Attorney, Agent, or Firm*—Anderson Kill Olick & Oshinsky

[57] ABSTRACT

An apparatus for regulating and adjusting powered rolls for conveying metal plates supported in tubular crossbeams which is always reliable in operation is very simple in its construction and protected from rust deposits, especially in shears for edge trimming and/or for longitudinal or transverse division of the plates, is created by having regulation elements as wedges which are displaceably arranged within a bearing bracket and are in operational connection with the adjustment elements.

4 Claims, 2 Drawing Sheets

APPARATUS FOR DISPLACING AND ADJUSTING POWERED ROLLS SUPPORTED IN CROSSBEAMS FOR CONVEYING METAL PLATES

BACKGROUND INVENTION

The present invention relates to an apparatus for displacing and adjusting driven rolls supported in tubular crossbeams for conveying metal plates, especially in shears for edge trimming and/or longitudinal or transverse division of metal plates. The crossbeams are suspended in bearing brackets at the shear stand so as to be pivotable around a stationary axis essentially transversely to the principal plane of the passing metal plate and are arranged to be displaceable by means of devices relative to the metal plates. At least one bearing bracket is provided with displacement and adjustment means which enable horizontal and/or vertical displacement and adjustment of the crossbeam of the powered roll.

A device for displacing and adjusting powered rolls supported in crossbeams for conveyance of metal plates, especially in shears for edge trimming and/or longitudinal and transverse division of the metal plates, is known from the German Offenlegungsschrift 3542007. In this known device, the crossbeams are suspended from the shearing stand by means of bearing brackets, so as to be pivotable around a stationary axis transversely to the principal plane of the passing metal plate. Herein the bearing brackets comprise two cheeks, which are connected with each other so as to be displaceable approximately horizontally and transversely to the longitudinal axis of the crossbeam. The one cheek is supported on the stationary axis at the shear stand, while the other cheek carries the crossbeam supporting the powered rolls. Displacement means are located between the two cheeks of the bearing bracket and comprise at least one helical spindle which is fixed in one cheek to be rotatable and axially not displaceable, while the spindle is in connection with the other cheek by means of an adjusting or actuation thread.

Furthermore, adjusting cylinders are arranged between the crossbeam and the bearing brackets for adjusting the height of the powered roll, which consists respectively of two actuation and support screws, which engage from opposite sides at the arm of the second cheek of the bearing bracket. In this way a displacement for correcting the traveling direction of the band as well as an adjustment of the plate traveling direction within the shears is possible, without this affecting the adjustment of the runover for the powered rolls. By runover what is meant is the deviation of the axis of the powered rolls from the horizontal.

This known device for displacement and adjustment of powered rolls supported in tubular crossbeams for conveyance of metal plates is however comparatively complicated as far as the design structure is concerned and is not always reliable in operation because of rust accumulations, etc. at the numerous externally located displacement and adjustment elements.

SUMMARY OF THE INVENTION

Proceeding from this known state of the art, it is the object of the present invention to provide an apparatus for displacing and adjusting powered rolls supported in tubular crossbeams for conveying metal plates, which apparatus is very simple in its design construction and is always reliable in its operation.

Pursuant to this object, and others which will become apparent hereafter, one aspect of the present invention resides in the displacement elements consisting of wedges, which are arranged inside of the bearing bracket so as to be displaceable between the crossbeam of the powered roll and the bearing bracket, and which are in operational or effective connection with the adjustment element. Because the wedges for displacing the powered rolls are arranged within the bearing brackets between the crossbeam of the powered roll and the bearing bracket, they are safely protected from external effects, especially from rust, jamming, etc., so that they are always ready and able to function.

Since the displacement systems in operational practice are mostly regulated only after several years, often without intervening maintenance, and during operation in the rolling line are exposed to continuous heat, dirt, steam and wear, individual parts can possibly rust to such an extent that they prevent movement. Even if a stoppage caused by rusting occurs, the inventive apparatus can be made to operate again in a simple manner, which does not exist in the known systems. Furthermore this adjustment or displacement arrangement in the invention enables, in a particularly simple manner, a runover adjustment of the powered rolls completely independent of the traveling direction of the plates through the shears, whereby the straight runout of the plate is assured. Over and above this, the apparatus designed according to the invention for regulating and adjusting powered rolls is essentially simpler, free of play and operationally reliable in its design structure compared to the hitherto known regulation and adjustment arrangement for powered rolls.

In order to achieve a clearance-free functioning of the regulation and adjustment arrangement when regulating according to the invention, actuation screws with spring washers are arranged at the lid or cover of the bearing bracket in a further advantageous embodiment of the invention for adjusting the crossbeams of the powered rolls.

In accordance with another embodiment of the invention, the bearing bracket is designed to be U-shaped and terminated by a removable lid on the externally open side. Because of this U-shaped design of the bearing bracket, the installation and removal of the regulating and adjusting elements in the invention is considerably simplified and facilitated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
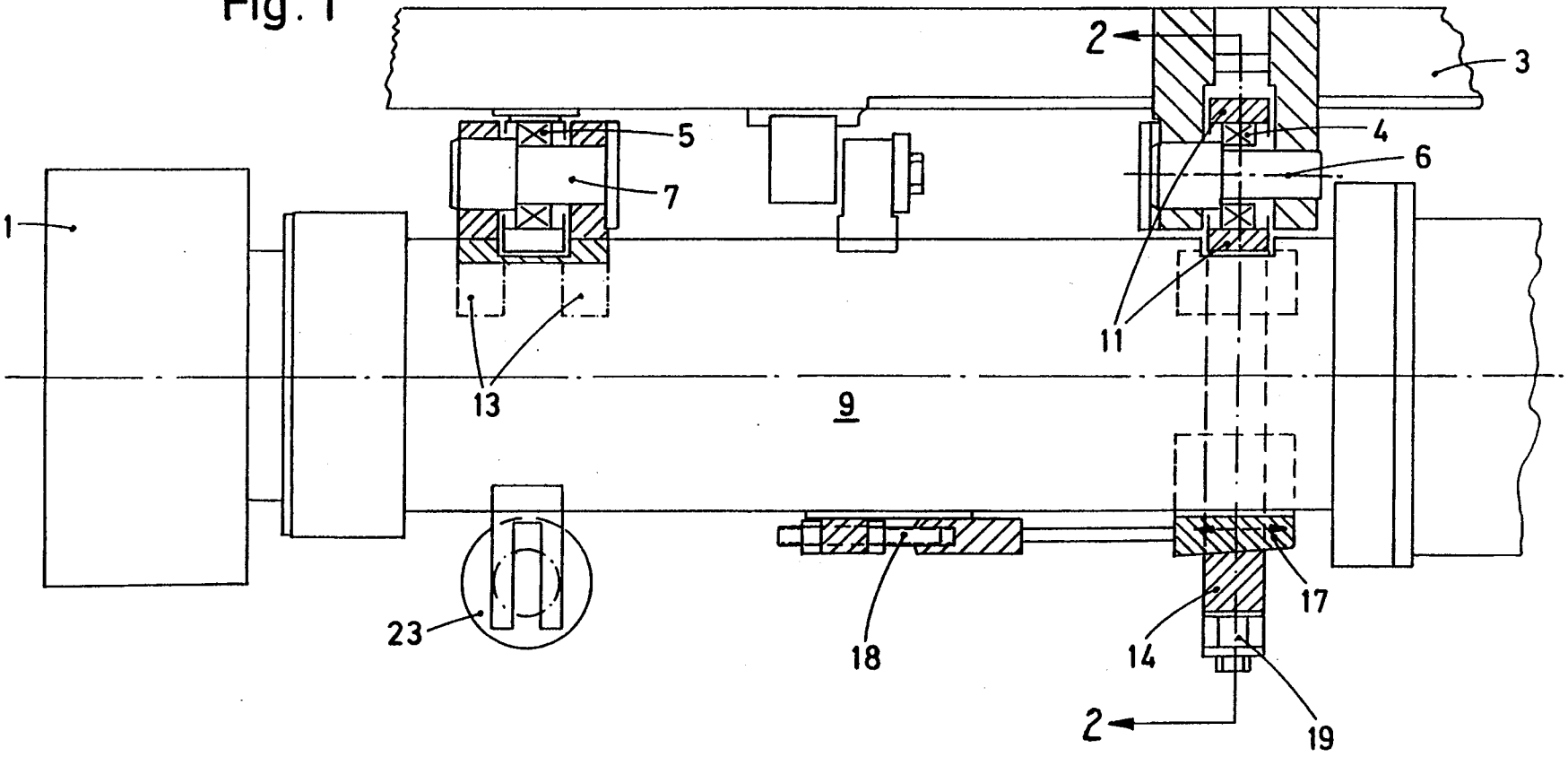
FIG. 1 is a plan view of a pair of powered rolls arranged pivotably at a shear stand, with regulating and adjusting means according to the invention at the upper powered roll.
Figure 2:
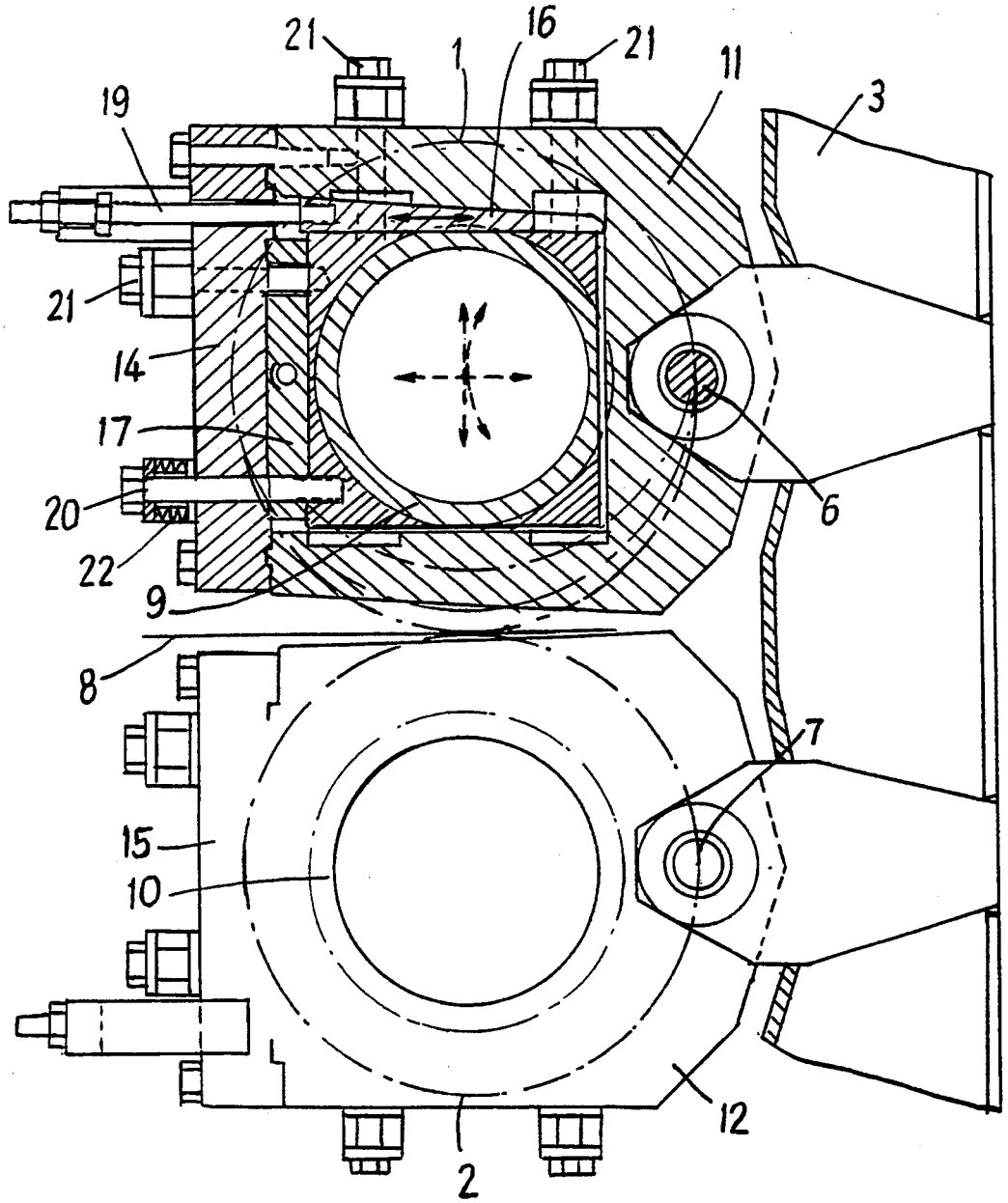
FIG. 2 is a section through the line 2—2 in FIG. 1.

As FIGS. 1 and 2 show, powered rolls 1, 2 for conveying metal plates, especially for edge trimming and/or for longitudinal and transverse division of the plates, are suspended from a stand 3, in particular a shear stand, so as to be pivotable around stationary axes 6, 7 arranged in bearings 4, 5 transversely to the principal plane of a passing metal plate 8. For this purpose, bearing brackets 11, 12 as connection elements are provided at the right-hand side of tubular crossbeams 9, 10, in which brackets the powered rolls 1, 2 are supported. On the left-hand side, trusses 13 by way of connection elements are fastened to the tubular crossbeams 9, 10. Bearing brackets 11, 12 arranged on the righthand side at the tubular crossbeams 9, 10 are U-shaped and terminated respectively by a removable lid or cover 14 or 15 on the externally open side.

The bearing bracket (11) embracing the tubular crossbeam 9 of the upper powered roll 1 is provided with regulating- and adjusting means, which, according to the invention, consists of wedges 16 and 17 which are arranged within the bearing bracket 11 so as to be displaceable between the crossbeam 9 and the bearing bracket 11. Regulating screws 18, 19 for displacing the wedges 16, 17 are arranged externally at the crossbeam 9 or at the bearing brackets 11, which screws are in operative connection with the wedges 16, 17. By displacing the wedge 16 with the screw 19 there occurs a displacement or regulation of the crossbeam 9 and thus also of the powered roll 1 within the bearing bracket in a vertical direction, while by displacing the wedge 17 by the screw 18 there occurs an adjustment of the crossbeam 9 and with it also of a powered roll within the bearing bracket 11 in a horizontal direction. In this way, a runover adjustment of the powered rolls 1, 2 is achieved in a particularly simple manner, which is completely independent of the traveling direction of the plate 8.

According to the invention, actuation screws 20, 21 with disk springs 22 can be provided for the adjustment of the crossbeam 9 and with it of the powered roll 1, which screws are arranged at the lid 14 of the bearing bracket 11 or at the bearing bracket 11. In order to adjust the crossbeam 9 and with it the powered roll 1, one only needs to loosen the actuation screws 20, 21, and for this already half a turn is sufficient. The disk springs 22 of the adjusting screw 20 maintain the mechanism very advantageously free of play or clearance, then one displaces one or two wedges 16, 17 as required and tightens the actuation screws 20, 21 again. Upon seizing due to rust the apparatus is made to be free or made to operate again in a simple manner by loosening the screws 20, 21. Additionally a hydraulic piston cylinder unit 23, known as such, for pivoting the powered roll 1, is arranged at the housing or the shear stand 3, which unit 23 engages externally at the crossbeam 9, as can be seen in Fig. 1.

The inventive apparatus for regulating and adjusting powered rolls supported in tubular crossbeams for conveying metal plates, especially in shears for edge trimming and/or longitudinal or transverse division of the plates, compared to hitherto known similar devices, as shown particularly in drawing Figs. 1 and 2, is not only very simple in its design construction and particularly easy to operate, but is also always reliable in operation.

While the invention has been illustrated and described as embodiment in an apparatus for displacing and adjusting powered rolls supported in crossbeams for conveying metal plates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An apparatus for moving and adjusting powered rolls for conveying metal plates and supported in tubular crossbeams, comprising:

a shear stand;

bearing brackets which suspend the crossbeams at the shear stand so as to be pivotable around a stationary axis essentially transverse to a principal plane of a passing metal plate;

separate means for adjusting each of the crossbeams relative to the metal plate;

moving means and adjustment means provided at at least one bearing bracket for at least one of horizontally adjusting and vertically adjusting the crossbeam of a powered roll, the moving means including wedges within a bearing bracket to be displaceable between the crossbeam of the powered roll and the bearing bracket, and to be in operative connection with adjustment elements; and a horizontal wedge as part of the wedge for vertically adjusting the powered roll and a vertical wedge (17) for horizontally adjusting the powered roll.

2. An apparatus according to claim 1, wherein the wedges (16, 17) are connected with each other by regulating screws (18, 19) that are offset to each other by 90°, the regulating screws being provided at one of the crossbeam (9) and the bearing bracket (11) so as to be adjustable from outside the crossbeam and bearing bracket.

3. An apparatus according to claim 1, wherein the adjustment means includes actuation screws (20, 21) with disk springs (22) arranged at the bearing bracket (11) so as to permit adjustment of the crossbeam (9) of the powered roll (1).

4. An apparatus according to claim 1, wherein the bearing bracket (11) is U-shaped and has an externally open side at which a removable cover is provided.

* * * * *